US005600928A

United States Patent [19]

Hess et al.

[11] Patent Number: 5,600,928

[45] Date of Patent: Feb. 11, 1997

[54] ROOF VENT PANEL

[75] Inventors: John C. Hess, Lititz, Pa.; William R. Walter, Bancroft, Mich.; Edwin F. Trautman, Jr., Bethlehem, Pa.

[73] Assignee: UC Industries, Inc., Parisppany, N.J.

[21] Appl. No.: 508,179

[22] Filed: Jul. 27, 1995

[51] Int. Cl.[6] ..... E04C 2/32; E04C 2/20

[52] U.S. Cl. ..... 52/309.4; 52/630; 428/158; 428/183

[58] Field of Search ..... 52/630, 674, 537, 52/783.19, 798.1, 95, 309.4; 428/167, 179, 182, 183, 213, 156, 158; 454/250, 260, 365, 366

[56] References Cited

U.S. PATENT DOCUMENTS

| | | | |
|---|---|---|---|
| 2,870,981 | 1/1959 | Dellinger et al. | 52/630 |
| 3,683,785 | 8/1972 | Grange | 98/35 |
| 3,824,664 | 7/1974 | Seeff | 52/630 |
| 4,102,092 | 7/1978 | Ward | 52/92 |
| 4,125,971 | 11/1978 | Ward | 52/92 |
| 4,214,510 | 7/1980 | Ward | 98/37 |
| 4,237,672 | 12/1980 | Peterson | 52/743 |
| 4,274,239 | 6/1981 | Carroll | 52/309.8 |
| 4,406,095 | 9/1983 | Slavik | 52/95 |
| 4,446,661 | 5/1984 | Jonsson et al. | 52/95 |
| 4,660,463 | 4/1987 | Bottomore et al. | 98/37 |
| 4,745,716 | 5/1988 | Kuypers | 52/169.5 |
| 4,881,355 | 11/1989 | Bosl et al. | 52/630 |
| 4,916,875 | 4/1990 | Kashiwagi | 52/302 |
| 4,995,308 | 2/1991 | Waggoner | 98/37 |
| 5,341,612 | 8/1994 | Robbins | 52/95 |

FOREIGN PATENT DOCUMENTS

| | | | |
|---|---|---|---|
| 13763 | of 1885 | United Kingdom | 52/630 |
| 2145756 | 4/1985 | United Kingdom . | |

OTHER PUBLICATIONS

Foam Plastics of New England, "Dura–Foam® Rafter–Vent For The Extended Life of Your Roof", 1984.

UC Industries, Inc., "Raft–R–Mate Extruded Polystyrene Attic Rafter Vent," Nov. 1993, UC–178.

*Primary Examiner*—Michael Safavi

*Attorney, Agent, or Firm*—Renner, Otto, Boisselle, Sklar

[57] ABSTRACT

An extruded foam polystyrene sheet is formed into a roof vent panel for a sloping roof at the eaves. The panel has flanges and an offset wall and is formed into through troughs end-to-end which are divided by truncated triangular ridges extending from the offset wall. The ridge is reinforced by gussets and saddles which are formed as sets along the ridges. The gussets extend from the offset wall to the ridge side walls and the saddles connect the ridge side walls below the truncated apex of the ridge. The gussets on each side wall are spaced and paired with one of each pair at the end of a saddle.

12 Claims, 1 Drawing Sheet

ROOF VENT PANEL

This invention relates generally as indicated to a roof vent panel, and more particularly to a low cost yet highly efficient vent panel for use on a sloping roof to assure unrestricted air flow from the soffit area past ceiling insulation to an attic vent.

BACKGROUND OF THE INVENTION

Buildings with pitched roofs usually have open and unheated attics. Insulation for the room below is usually provided by fibrous insulation above the horizontal ceiling. If the insulation blocks airflow from the soffit vents at the eaves to attic vents, usually at the pitch peak, heat loss at the eaves may occur and with freezing and thawing temperatures, ice dams may form at the eaves causing roof leaks usually in the coldest of weather. In the summer, improper ventilation of the attic can lead to significant thermal inefficiency, excess humidity and other problems. It is accordingly desirable that proper ventilation from the lower eaves to the attic vents be maintained to avoid such heat and moisture problems.

To achieve such venting, a wide variety of sheet-like products have been used which are fastened to the underside of the roof between the rafters. Such products may include flanges providing ease of fastening and a spaced or offset wall forming open troughs extending end-to-end. It has been found that such products made from extruded foam polystyrene sheet have excellent break resistance and resist moisture so they will not rot or deteriorate. Extruded polystyrene has greater strength than simply expanded polystyrene such as bead board or sheet.

The lateral space of the trough or airway, however, creates a flexure problem, particularly at the ends of the sheet. It has, accordingly, been found advantageous to provide a stiffening ridge along the center of the trough end-to-end. However, when forming large extruded foamed polystyrene sheet between precision matched metal dies, the forming process attenuates the sheet reducing the wall thickness of the sides of the ridge. This in turn lessens the compressive strength of the ridge. Also, particularly along the root of the base and at the apex of the ridge, the corners are in effect creases, and with the reduced wall thickness of the ridge, such corners become a possible point of failure, particularly in handling and installation.

Accordingly, it would be useful to have a trough ridge from end-to-end of the panel where the corners or creases of the ridge were strengthened and without significantly obstructing the airway through the trough on each side of the ridge.

SUMMARY OF THE INVENTION

A roof vent panel for a sloping roof is a relatively large elongated panel formed from extruded polystyrene foamed sheet. It has lateral flanges which facilitate the fastening of the panel to the underside of a sloping roof at the eaves. An offset wall forms a trough between the flanges with side walls sloping to the flanges. The trough is divided by a generally triangular ridge which has a height equal to the depth of the trough. The ridge extends from end-to-end of the panel. The ridge shortens the lateral span of the offset wall forming the trough and in effect forms two side-by-side smaller, and stronger, troughs which are open end-to-end of the panel. The triangular ridges are truncated and are formed such that all corners are obtuse angles. Although the side walls of the ridges have reduced wall thickness, they are reinforced at the offset wall base corner or notch by relatively short open channel gussets formed slightly asymmetrically between the offset wall and ridge side wall. The back of the gussets extends almost normal to an angle bisecting the obtuse angle between the offset wall and ridge side wall. The side walls of the gussets are splayed, and such gussets extend to about one fourth the height of the ridge side wall. The gussets are paired with respect to saddles formed in the truncated top of each ridge. The saddles in effect join the two ridge side walls at a height of about one half the height of the side wall. Accordingly, for each saddle there will be four gussets arranged symmetrically. There may be four saddle and gusset sets spaced equally along the ridge, although the saddle and gusset sets at the ends are fairly close to the end edge of the panel. The panel is in effect duplicated along its center to form two troughs, each divided by a ridge. An end-to-end perforation in the middle of the panel provides for lateral separation in the event an entire panel will not fit between the rafters.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figures 1, 2, 3, 4:
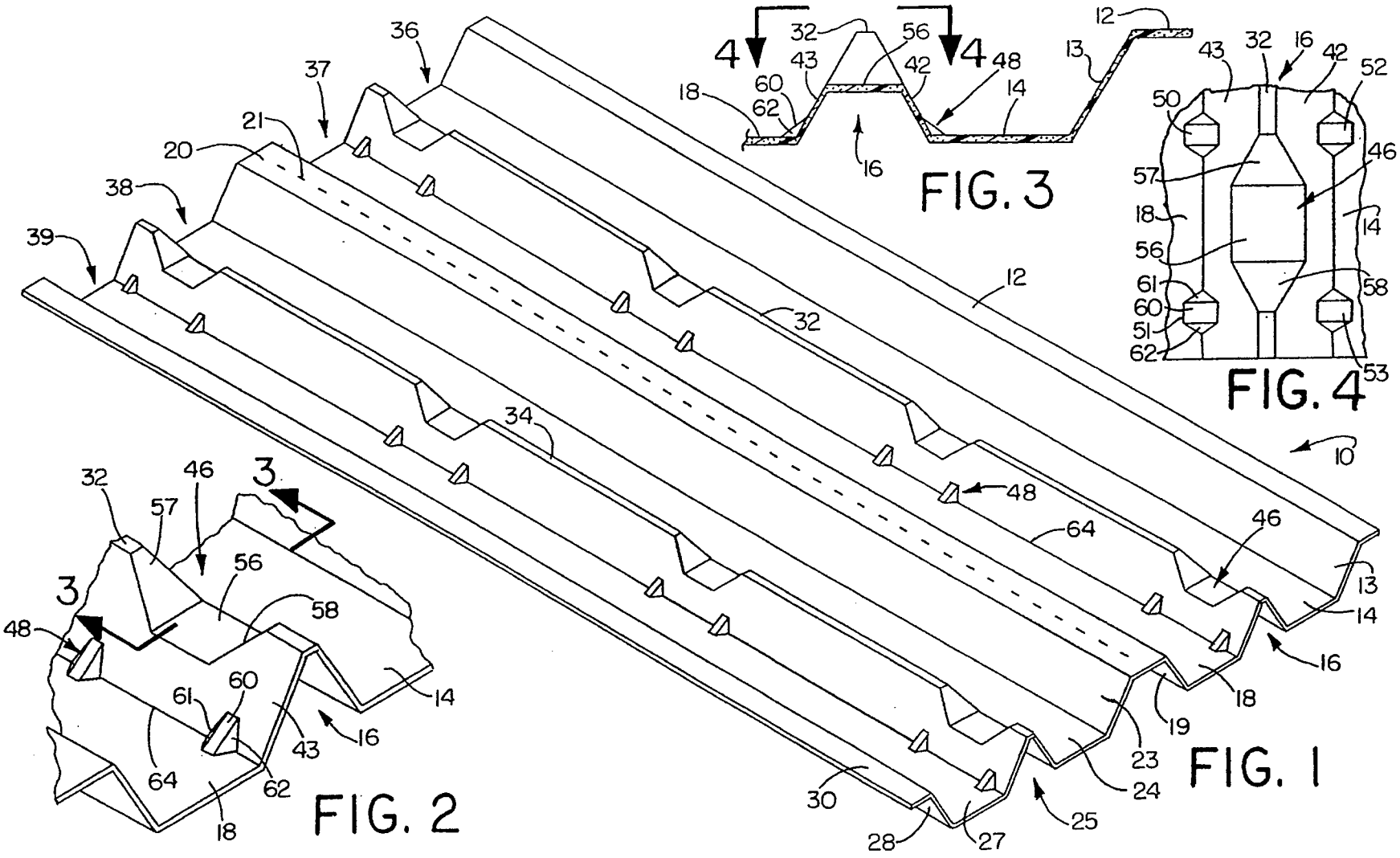
FIG. 1 is an isometric view of a roof vent panel in accordance with the present invention.
FIG. 2 is an enlarged fragmentary view of the ridge reinforcing structure showing the saddle and gusset arrangement.
FIG. 3 is an enlarged fragmentary vertical section taken substantially from the line 3—3 of FIG. 2.
FIG. 4 is a fragmentary top plan view of the saddle-gusset set ridge reinforcement as seen from the line 4—4 of FIG. 3.

Referring initially to FIG. 1, there is illustrated a roof vent panel 10 in accordance with the present invention. The panel 10 is formed from a sheet of extruded foamed polystyrene. The panel is of substantial size and is elongated, being approximately twice as long as it is wide. For example, the panel may be over a meter in length and over half a meter in width. The panel is designed to be fastened to the underside of the roof at the eaves between the rafters so that the side facing the viewer in FIG. 1 is normally the top of the panel.

Reading from right to left in FIG. 1, the panel is formed with an edge flange 12, a sloping lateral wall 13 which extends from the flange 12 to offset wall segment 14 which extends parallel to but downwardly offset from the flange 12. Next to the offset wall segment 14 is a triangular ridge shown generally at 16 which extends from end-to-end of the panel. Next to the triangular ridge there is a further section of the offset wall shown at 18, another transition wall 19 which terminates in a center wall 20 which is in the same plane as the flange 12. The center wall 20 is perforated throughout its length as indicated at 21. The perforations may be simply scorings or actual holes, round or rectangular, to permit the panel to be divided longitudinally into two equal parts. Whether the whole panel or half a panel is employed will of course depend upon the spacing of the rafters. From the center wall perforation, the remaining half of the panel is a duplicate of the half just described including sloping transition wall 23, offset wall section 24, triangular ridge 25, offset wall section 27, lateral transition sloping wall 28, and fastening flange 30.

It is noted that the two triangular ridges 16 and 25 are truncated and provided with a narrow flat apex as seen at 32 and 34, respectively. These apex portions of the ridges are designed to abut against the underside of the roof, although not necessarily be fastened thereto. Accordingly, the flange 12, the apices 32 and 34, the center wall 20, and the flange 30 are all in the same plane. The same is true of the offset wall formed by the offset wall sections 14, 18, 24, and 27.

It can now been seen that the ridges 16 and 25 divide the two sides of the panel into two equal side-by-side air troughs which extend from one end of the panel to the other. Such air troughs are seen at 36 and 37 on each side of the ridge 16. The ridge 25 divides the other side of the panel into continuous equal air troughs 38 and 39. Because of the ridges, the lateral span of the offset wall sections forming the troughs is reduced and pressure from beneath the panel is less likely to flex the wall inwardly significantly restricting the passage of air through the air troughs. In assembly, fasteners are intended to extend through the flanges 12 or 30 and also through the perforated center wall 20, or half of the center wall if the panel is divided longitudinally.

Referring now to FIG. 3, it will be seen that in the forming process, walls at an angle to the original plane of the foamed polystyrene extruded sheet will be attenuated or of less thickness than walls parallel to such sheet. Accordingly, the sloping side walls 42 and 43 of the ridge 16 will be of less thickness than, for example, the wall sections shown at 12, 14 or 18, for example.

To strengthen and rigidify the ridges, such ridges are formed with equally longitudinally spaced saddles shown generally at 46. Also, extending between the offset wall sections and the side walls of the ridges, gussets shown generally at 48 in FIG. 1 are provided. While each saddle is of the same construction and each gusset is of the same construction, it is noted that the gussets are arranged in pairs with a gusset of each pair being positioned substantially transversely opposite the end of the saddle. The pairs of gussets are also transversely aligned on each side of the ridge. Thus, the saddle 46 seen in FIGS. 2, 3 and 4, is provided with one pair of gussets seen at 50 and 51 on one side of the ridge and another pair seen at 52 and 53 on the opposite side of the ridge. The gussets are transversely aligned at the end of the saddle 46 and symmetrically arranged with respect to such saddle.

Since the structure of each gusset and each saddle is the same, only one gusset and one saddle will be described in detail. The saddle 46 includes a horizontal wall 56 and splayed end walls 57 and 58. The bottom wall 56 of the saddles extends between the ridge side walls 42 and 43 as seen more clearly in FIG. 3, and they intersect the side walls of the ridge at approximately half the height of the ridge. The splayed walls 57 and 58 close the longitudinal ends of the saddle.

Each gusset includes a back wall 60 as seen in FIGS. 2, 3 and 4, and splayed side walls 61 and 62. The back wall 60 is not quite symmetrical in the notch 64 between the offset wall section 18 and the side wall 43 of the ridge. This slight asymmetrical arrangement enables the back wall of the gusset to intersect the ridge side wall at a substantially greater distance from the notch than its intersection with the offset wall section 18. Thus, the back wall of the gusset is more steeply inclined than it would be were it symmetrical in the notch. The back wall of the gusset intersects the ridge side wall at about one fourth the height of the ridge or at about half the height of the saddle bottom wall. Accordingly, the gussets project only slightly into the airway troughs 36, 37, 38 and 39 formed by the roof vent panel. The gussets buttress the thinner side walls of the ridges and resist folding of the sheet material of the panel along the notch 64. The saddles also buttress the side walls of the ridges. The saddles also provide for air flow between the airway troughs, providing better air flow through the panel while still maintaining the fibrous insulation normally employed away from the underside of the roof which would tend to block such air flow.

The four gussets arranged around each saddle form a cooperating stiffening structure which provides excellent rigidity to the panel while simplifying its overall structure. The paired gusset-saddle arrangements are spaced equally along the ridges and in the illustrated embodiment there are four such sets. It is noted, however, that the two sets at the ends are spaced fairly closely to the end of the panel so that the panel is transversely reinforced quite close to its ends. This provides increased stiffness and strength at the end where needed in both handling and installation. With the splayed symmetrical side walls of both the gussets and the saddles, it is noted that no fold or corner in the structure of the panel approaches a right angle or even an acute angle bend. All of the corners involved are at a significantly obtuse angle.

It can now be seen that there is provided a simplified roof vent panel which has continuous reinforcing ridges throughout its length, yet still has airway troughs open from end-to-end, such troughs being formed on each side of a reinforced ridge.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

We claim:

1. A structure sloping roof vent panel comprising a large elongated panel of extruded foam polystyrene sheet having lateral flanges to facilitate the fastening of the sheet to the underside of a sloping roof at the eaves, an offset wall spaced from said flanges forming an airway trough, and at least one generally triangular ridge extending from said offset wall and open from one end of the vent panel to the other, said ridge having thinner side walls than said offset wall, and formed gussets extending from said offset wall to said thinner side walls of said ridge to reinforce and strengthen said panel sheet to maintain unobstructed venting through said trough when installed.

2. A vent panel as set forth in claim 1 including saddles in said ridge connecting the side walls of the ridge below its apex.

3. A vent panel as set forth in claim 2 wherein said gussets are paired in sets of two along the ridge.

4. A vent panel as set forth in claim 3 wherein said paired gussets are aligned transversely of the ridge.

5. A vent panel as set forth in claim 4 wherein one gusset of each pair is at the end of each saddle.

6. A vent panel as set forth in claim 5 wherein said gusset pairs and saddles are arranged symmetrically.

7. A vent panel as set forth in claim 1 wherein each gusset includes a back wall and splayed side walls, the gusset back wall extending at an angle from the offset wall to the ridge side wall.

8. A vent panel as set forth in claim 7 wherein said ridge side walls and said offset wall form a notch where they join and said gusset back wall is asymmetrically arranged in said notch between the offset wall and the ridge side wall, intersecting the ridge side wall at a substantially greater distance from the notch than its intersection with the offset wall.

9. A vent panel as set forth in claim 8 wherein said gusset back wall intersects the ridge side wall at about one fourth the height of the ridge.

10. A vent panel as set forth in claim 9 including saddles in said ridge connecting the side walls of the ridge below its apex.

11. A vent panel as set forth in claim 10 wherein said saddles include bottom walls extending between the ridge side walls, said gusset back wall intersecting the side wall of the ridge at about half the height of the saddle bottom wall.

12. A vent panel as set forth in claim 11 wherein said gussets are paired and said saddles and paired gussets are arranged symmetrically and equally spaced along the ridge.

* * * * *